US012442184B2

(12) United States Patent
Thomas

(10) Patent No.: US 12,442,184 B2
(45) Date of Patent: Oct. 14, 2025

(54) ASSEMBLY AND METHOD FOR ATTACHING EXTRUDED MEMBERS

(71) Applicant: SAS SYSTEMS AUSTRALIA PTY LTD, Maroochydore (AU)

(72) Inventor: Leslie James Thomas, Crows Nest (AU)

(73) Assignee: SAS Sysytems Australia PTY LTD, Maroochydore (AU)

( * ) Notice: Subject to any disclaimer, the term of this patent is extended or adjusted under 35 U.S.C. 154(b) by 835 days.

(21) Appl. No.: 15/734,089

(22) PCT Filed: May 31, 2019

(86) PCT No.: PCT/AU2019/050564

§ 371 (c)(1),
(2) Date: Dec. 1, 2020

(87) PCT Pub. No.: WO2019/227175

PCT Pub. Date: Dec. 5, 2019

(65) Prior Publication Data

US 2021/0214936 A1 Jul. 15, 2021

(30) Foreign Application Priority Data

Jun. 1, 2018 (AU) ..... 2018901978

(51) Int. Cl.

| | |
|---|---|
| ***E04B 2/74*** | (2006.01) |
| ***E04B 2/78*** | (2006.01) |
| ***E04F 11/18*** | (2006.01) |
| ***E04H 17/14*** | (2006.01) |

(52) U.S. Cl.

CPC ..... *E04B 2/7437* (2013.01); *E04B 2/7827* (2013.01); *E04B 2/7836* (2013.01); *E04F 11/1808* (2013.01); *E04F 11/1817* (2013.01); *E04H 17/1439* (2013.01); *E04H 17/1447* (2021.01); *E04H 17/1456* (2021.01); *E04H 17/1469* (2021.01); *E04B 2002/7446* (2013.01); *E04B 2002/7464* (2013.01); *E04F 2011/1821* (2013.01)

(58) Field of Classification Search

CPC .... E04B 2/7437; E04B 2/7827; E04B 2/7836; E04B 2002/7446; E04B 2002/7464; E04H 17/1456; E04H 17/1469; E04H 17/1417; E04H 17/1439; E04H 17/1447; E04F 11/1817; E04F 2011/1821; E04F 11/1808; E04F 11/1836

USPC ..... 256/65.11, 65.02

See application file for complete search history.

(56) References Cited

U.S. PATENT DOCUMENTS 1,376,150 A * 4/1921 Miller ..... E04F 11/181 256/72

2,970,677 A * 2/1961 Springs, Jr. ..... E04B 2/7435 52/239

(Continued)

*Primary Examiner* — Brent W Herring

(74) *Attorney, Agent, or Firm* — Patwrite Law; Mark David Torche

(57) ABSTRACT

An assembly of extruded members including: an extruded housing member including one or more holes formed along at least one side thereof for entry of ends of one or more second extrusions therethrough; and at least one extruded aluminum clamping member including one or more pairs of opposed clamping portions for clamping the ends of the one or more second extrusions therebetween.

12 Claims, 10 Drawing Sheets

(56) References Cited

U.S. PATENT DOCUMENTS

| | | | | | |
|---|---|---|---|---|---|
| 3,485,006 | A * | 12/1969 | Rozario | F16B 12/40 | 256/65.01 |
| 4,334,671 | A * | 6/1982 | De Guise | E04F 11/181 | 256/22 |
| 4,805,879 | A * | 2/1989 | Spera | E04F 11/181 | 256/22 |
| 5,702,090 | A * | 12/1997 | Edgman | E04H 17/1426 | 256/65.02 |
| 7,744,065 | B2 * | 6/2010 | Terrels | H02G 3/0456 | 256/19 |
| 11,549,279 | B2 * | 1/2023 | Hodgson | E06B 7/082 | |
| 11,598,116 | B1 * | 3/2023 | Palmegiani | E04H 17/21 | |
| 2011/0073824 | A1 | 3/2011 | Lappin et al. | | |
| 2011/0127482 | A1 * | 6/2011 | Lo | E04H 17/1417 | 256/68 |
| 2017/0370121 | A1 | 12/2017 | Lindsay | | |
| 2018/0274242 | A1 * | 9/2018 | Gonzato | E04F 11/1836 | |
| 2019/0136573 | A1 | 5/2019 | Hodgson et al. | | |

* cited by examiner

ASSEMBLY AND METHOD FOR ATTACHING EXTRUDED MEMBERS

TECHNICAL FIELD

The present invention concerns a method and apparatus for attaching extruded members to each other such as extruded plastic, vinyl, steel, composite and aluminum profiles.

RELATED APPLICATIONS

The present application claims priority from Australian provisional patent application No. 2018901978 filed 1 Jun. 2018, the entirety of which is incorporated herein by reference.

BACKGROUND ART

Any references to methods, apparatus or documents of the prior art are not to be taken as constituting any evidence or admission that they formed, or form part of the common general knowledge.

Extrusions of various materials are known and used in architectural and decorative applications. For example, it is known to extrude synthetic materials such as vinyl and also metals such as aluminum and steel. Welding, including thermoplastic welding and spot welding of metals may be used to attach different members to each other. For example, opposed extruded metal posts may be stamped along their lengths to form holes therethrough, ends of lateral members may then be inserted through the holes and welded in place to form a screen. Obviously attaching members by welding in the manner described is time consuming and involves making many welds which all need to be done to a high and consistent quality. It will be realized that much labor is required and so attachment in this fashion can be unduly expensive.

In the past attempts have been made to address the above problem. For example it has been known to produce hollow aluminum extrusions that are integrally formed with internal clamping arms. However, the internal clamping arms may be damaged by a mandrill during hole punching through a wall of the extrusion for entry of an end of a lateral member. Furthermore, the clamping arms may interfere with the mandrill so that it is not possible to make a cleanly punched hole through the wall. In addition internal clamping arms are typically impractical with steel extrusions since they may be too fine to extrude in steel and in any case they may lack the requisite shape memory to provide reliable clamping.

Additionally, there may be a need to attach members of different types to each other in some settings and doing so may be problematic since materials of different types may not be readily welded to each other.

There is a need for a method and apparatus for attaching elongate members together that is quick and easy to perform and which may be used with elongate members that are both of metal or which are of different types of material, including non-metals.

SUMMARY OF THE INVENTION

According to a first aspect of the present invention there is provided an assembly of extruded members including:

an extruded housing member including one or more holes formed along at least one side thereof for entry of ends of one or more second extrusions therethrough; and at least one extruded aluminum clamping member including one or more pairs of opposed clamping portions for clamping the ends of the one or more second extrusions therebetween.

In an embodiment the housing member and/or the one or more second extrusions are made of a synthetic material. For example the synthetic material may comprise a plastic such as vinyl.

The one or more holes formed along at least one side of the housing member may comprise an opening formed along an entire length of a side of the housing member.

The housing member may be formed with one or more longitudinal retainers for engaging portions of the at least one clamping member.

The longitudinal retainers are preferably located on opposed internal walls of the housing members wherein the extruded aluminum member extends between the longitudinal retainers. Alternatively a single retainer may extend along one internal wall of the housing member.

In an embodiment the one or more longitudinal retainers comprise slots for receiving portions of the at least one clamping member.

The at least one clamping member may be formed with a transverse member such as a beam that extends between internal walls of the housing member. The beam may have opposed ends formed as tongues that are insertable into the slots.

In an embodiment a first pair of opposed clamping portions for engaging the ends of said second extrusions extends from a first side of the beam.

In an embodiment a second pair of opposed clamping portions may extend from a second side of the beam opposite the first side of the beam for engaging the ends of said second extrusions.

The at least one clamping member may comprise first and second clamping members and the assembly may include a clamping member retaining assembly defining at least first and second longitudinal retainers for engaging ends of the first and second clamping members.

The clamping member retaining assembly preferably has a transverse member such as a beam.

The transverse member may be formed with one or more holes for passage of the ends of the one or more second extrusions therethrough.

Preferably the at least one clamping member comprises a first clamping member and a second clamping member wherein the one or more pairs of opposed clamping portions comprises one pair of opposed clamping portions formed of a clamping portion on the first clamping member and a clamping portion on the second clamping member.

In an embodiment the at least one clamping member includes one or more bracing members that extend outwardly to make contact with one or more inner walls of the housing member to thereby strengthen the housing member.

In an embodiment the at least one clamping member comprises a cruciform clamping member wherein ends of the cruciform clamping member are bifurcated and wherein bifurcated portions of adjacent ends comprise the opposed clamping portions.

The housing member may comprise a square cross section extrusion wherein the one or more holes comprise one or more holes formed along each of four sides of the housing member and wherein the cruciform clamping member clamps ends of second extrusions at 90 degrees between adjacent second extrusions.

In an embodiment the at least one clamping member includes opposed inwardly converging elongate portions that converge inwardly into the first extrusion from the one or more openings to the opposed clamping portions, which are separated by an unclamped distance that is less than a width of a second extrusion for clamping therebetween.

In an embodiment the at least one opposed inwardly converging elongate portions are continuous with inwardly diverging elongate portions that diverge inwardly into the first extrusion from the opposed clamping portions.

The opposed clamping portions may include at least one detent for engaging at least one respective stop formed on the second extrusions for preventing withdrawal of the second extrusions from the at least one clamping member.

In an embodiment the at least one clamping member comprises a single piece wherein the inwardly converging elongate portions are integrally formed as part of the single piece.

According to a further aspect of the present invention there is provided a method for attaching an extruded housing member to one or more second extrusions comprising:

- inserting an extruded aluminum clamping member along the housing member; and
- inserting ends of the one or more second extrusions through one or more holes formed along at least one side of the housing member and between opposed clamping portions of the extruded aluminum clamping member.

The one or more holes may comprise an opening along an entire side of the housing member.

The housing member and/or the one or more second extrusions may be of a non-metallic material such as a plastic, for example vinyl.

The method may include inserting at least one portion of the extruded clamping member along a longitudinal retainer on an inner wall of the housing member.

According to another aspect of the present invention there is provided a method for attaching a first extrusion to one or more second extrusions comprising:

- forming one or more holes along the first extrusion;
- inserting an extruded aluminum clamping member along the first extrusion; and
- inserting ends of the one or more second extrusions through corresponding ones of the one or more holes and between opposed clamping formations of the extruded aluminum clamping member.

The method may include inserting portions of the extruded aluminum clamping member into retaining formations formed along the first extrusion.

BRIEF DESCRIPTION OF THE DRAWINGS

Preferred features, embodiments and variations of the invention may be discerned from the following Detailed Description which provides sufficient information for those skilled in the art to perform the invention. The Detailed Description is not to be regarded as limiting the scope of the preceding Summary of the Invention in any way. The Detailed Description will make reference to a number of drawings as follows.

DETAILED DESCRIPTION OF PREFERRED EMBODIMENTS

In the following description a number of exemplary embodiments of the invention will be discussed. Throughout the discussion like components and features may be identified from embodiment to embodiment with the same identifier numerals used in the figures. Multiple features or groups of features that are similar or which correspond to each other, for example left hand side and right hand side features or groups of features may be specifically referred to with item numbers that have an "a", "b", "c", . . . suffix. In some cases the features or groups of features that are similar or which correspond to each other will be referred to generally without the use of the "a" or "b" suffix depending on context.

Figure 1:
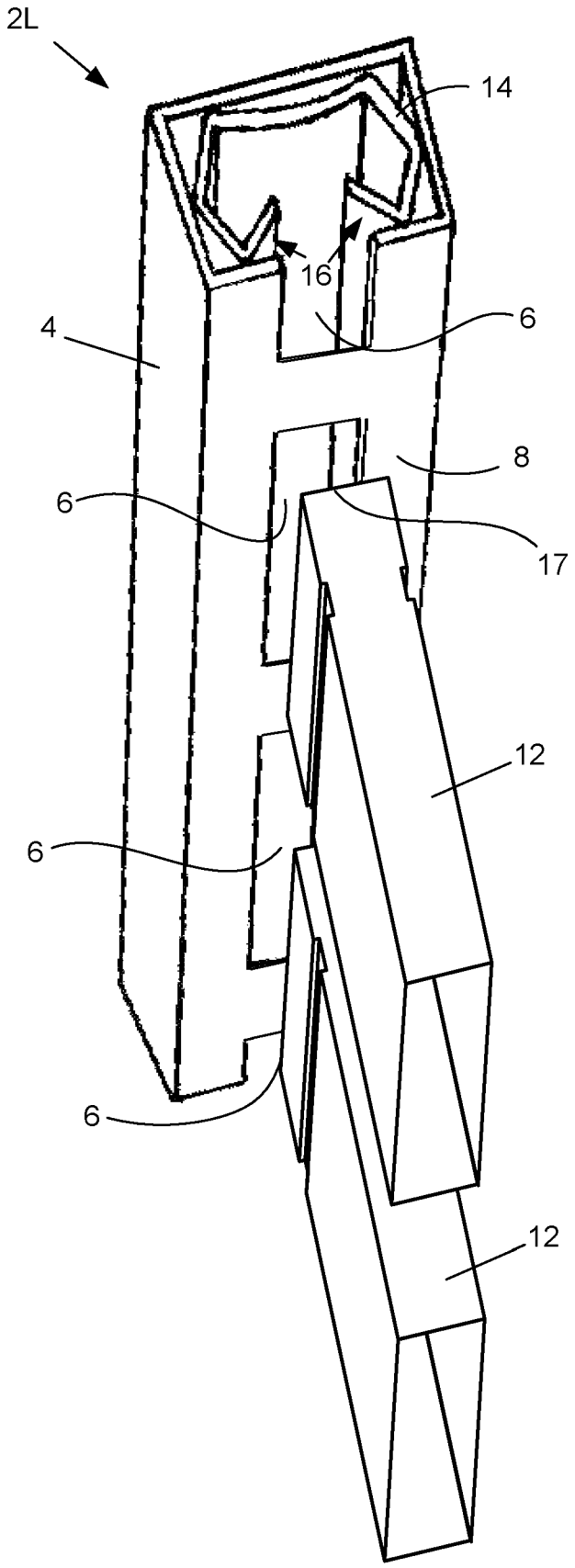
FIG. 1 Is a view of a top side and front of an assembly of extruded members according to an embodiment of the invention showing a number of second members prior to insertion of their ends into the assembly for clamping by a clamping member therein.
Figure 1A:
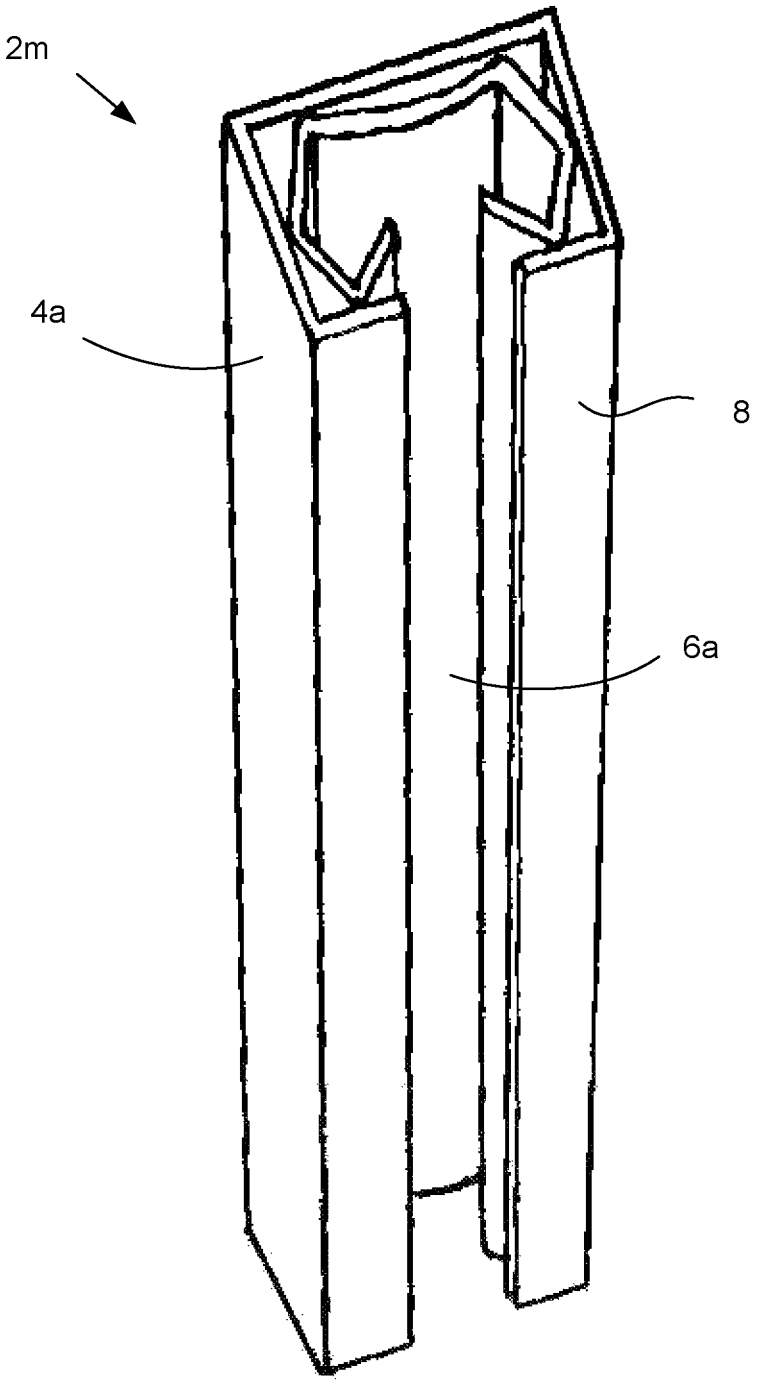
FIG. 1*a* Is a view of a variation of the assembly of FIG. 1 wherein a single hole is formed as an opening along one side of the housing member.

Referring now to FIG. 1, in a first embodiment an assembly of extruded members 2L includes a first extruded housing member 4, into an end of which an extruded aluminum clamping member 14 has been inserted. Extruded housing member 4 has one or more holes 6 formed along its side 8 for entry of ends 17 of one or more second extrusions 12 therethrough for clamping within the housing member 4 by opposed clamping portions 16 of the clamping member 14. In another embodiment that is illustrated in FIG. 1*a* the extruded housing member 4*a* of assembly 2*m* is formed with a single hole 6*a* that runs the entire length of side 8 so that housing member 4*a* has a "C-section" profile, for example.

Figure 2:
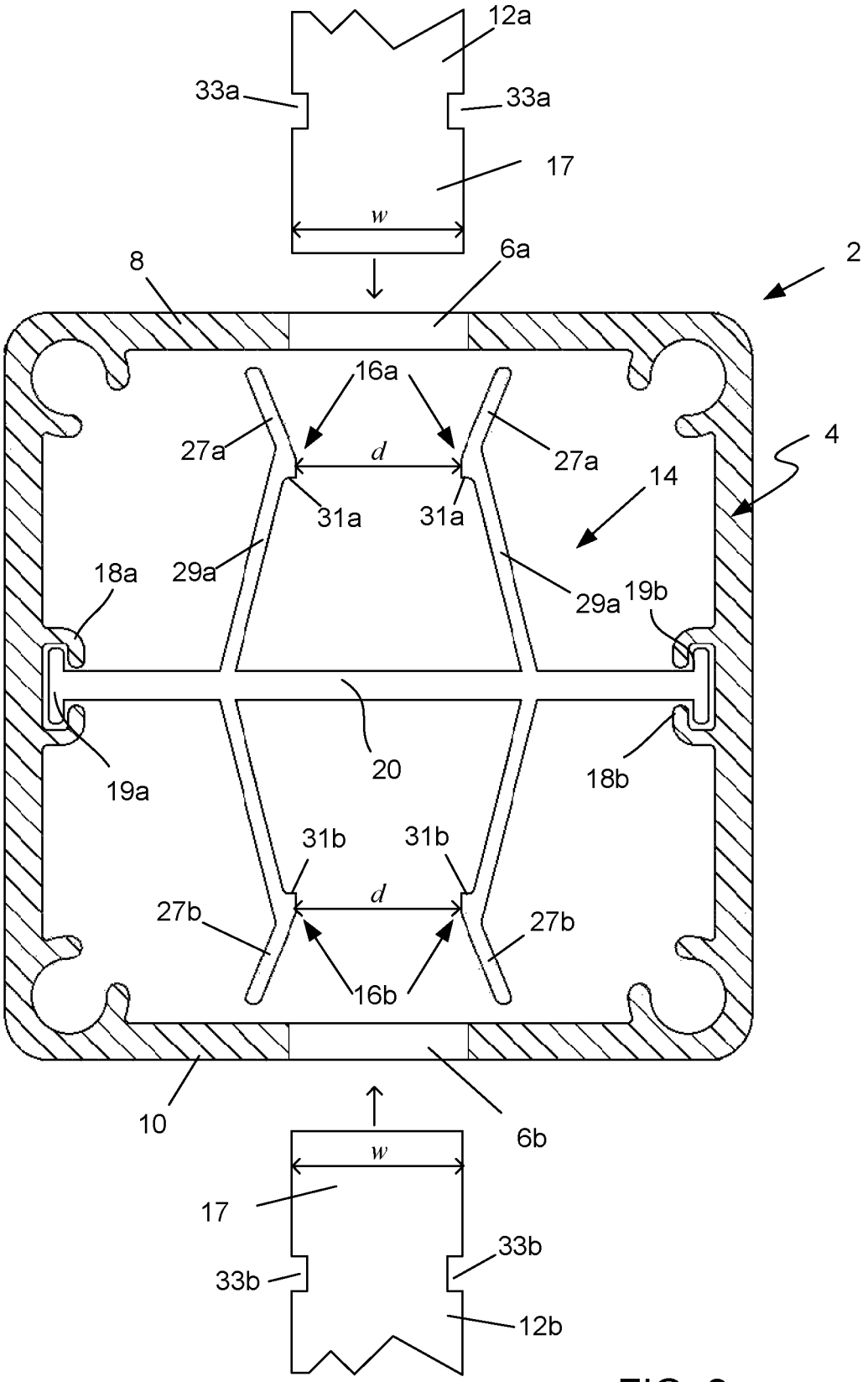
FIG. 2 is a cross section through an embodiment of the invention at a level of holes formed through two opposed sides of a housing member of the assembly.
Figure 2A:
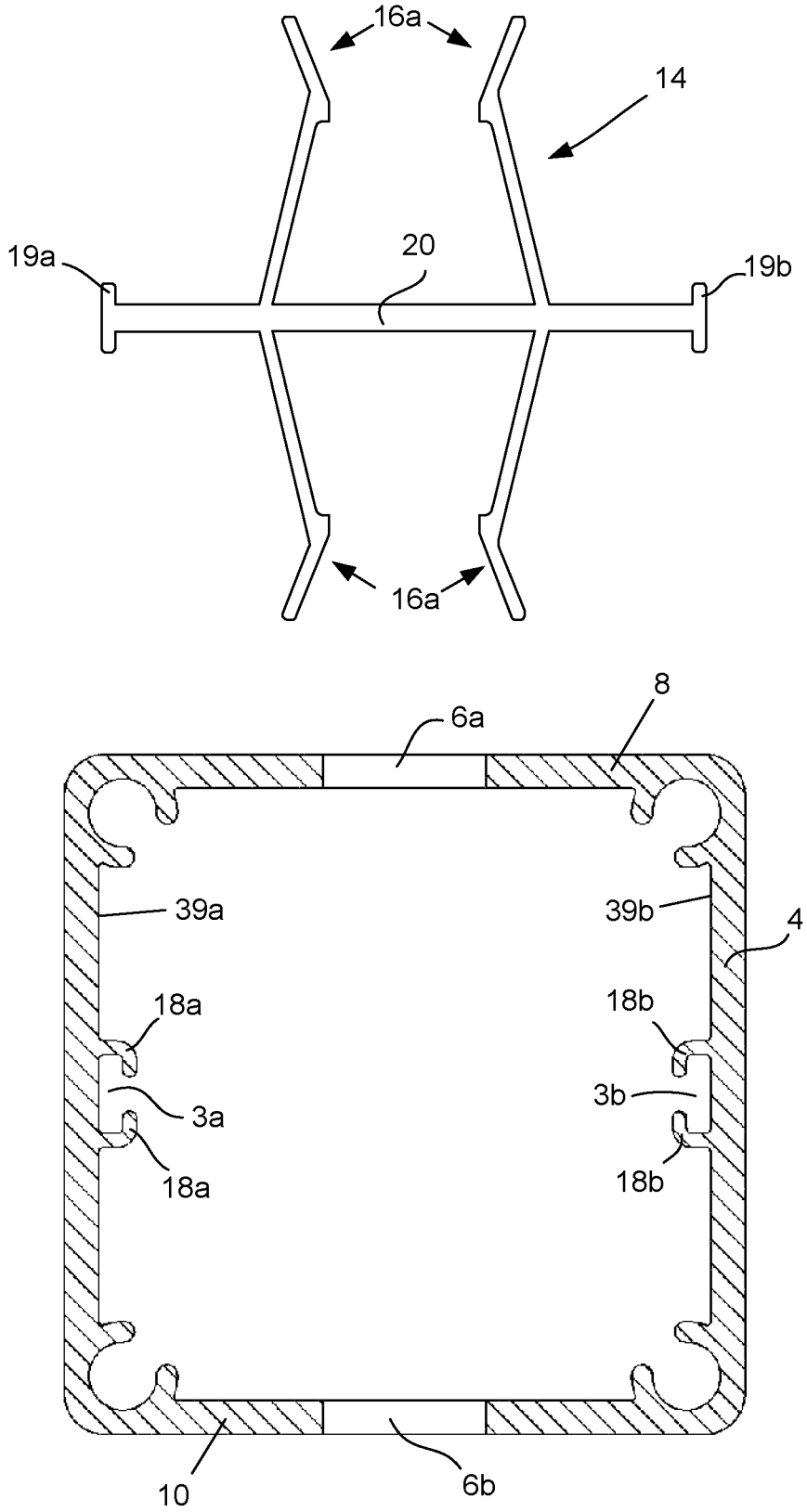
FIG. 2*a* comprises end views of a clamping member and a housing of FIG. 2 prior to insertion of the clamping member into the housing member.

Referring now to FIG. 2, a cross section through an assembly of extruded members 2, according to a further embodiment, is depicted. Assembly 2 includes a first extruded housing member 4 into which an extruded aluminum clamping member 14 has been inserted. Extruded housing member 4 has one or more holes 6*a*, 6*b*, formed along first and second sides 8, 10 thereof for entry of ends 17*a*, 17*b* of one or more second extrusions 12*a*, 12*b* therethrough. FIG. 2*a* shows the housing member 4 and clamping member 14 prior to insertion of the clamping member into an end of the housing member 4.

The first extruded housing member 4 is formed with longitudinal retainers 18*a*, 18*b* that are located on opposed internal walls 39*a*, 39*b* of the housing member 4 wherein the clamping member 14 includes an elongate transverse member in the form of a beam 20 that extends between the longitudinal retainers 18*a* and 18*b*. The beam preferably terminates at either end with a tongue 19*a*, 19*b*. The longitudinal retaining members define slots 3*a*, 3*b* (best seen in FIG. 2*a*) that capture tongues 19*a*, 19*b* therein.

The extruded aluminum clamping member 14 includes two pairs of opposed clamping portions 16*a*, 16*b*, which extend from opposite sides of the beam 20 towards respective holes 6*a*, 6*b*, on side walls 8, 10, for clamping the ends 17 of the second extrusions 12 therebetween.

Figure 3:
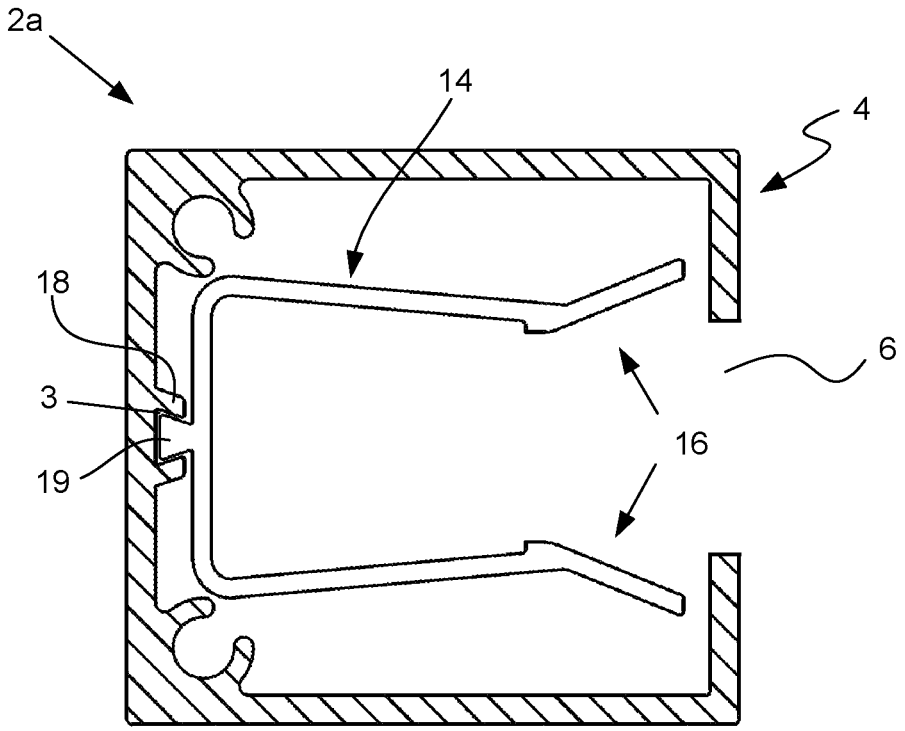
FIG. 3 is an end view of an assembly of extruded members according to a further embodiment of the present invention.

FIG. 3, is an end view of an assembly 2*a* according to another embodiment of the invention wherein the extruded aluminum clamping assembly 2*a* is provided in a U-form (or as it might be referred to "C" shaped) profile and has a single pair of opposed clamping portions 16. In this embodiment the tongue 19 extends away from the clamping portions 16 to be received in a slot 3 defined by the longitudinal retaining formation 18.

Figure 4:
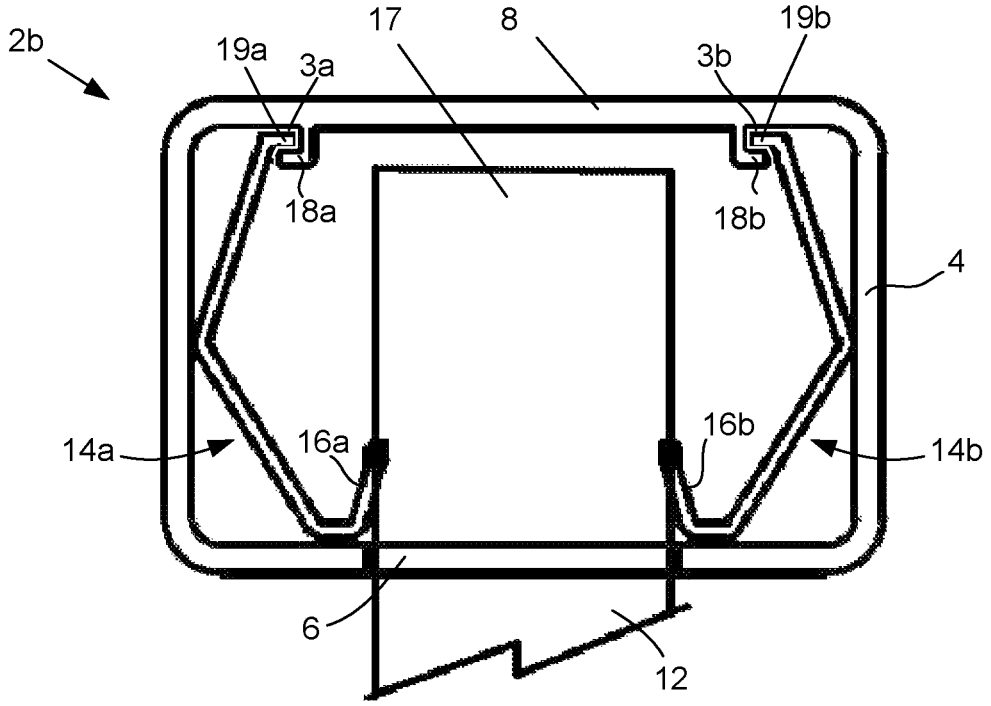
FIGS. 4 to 12*a* are end views of assemblies of extruded members according to further embodiments of the present invention shown in use.

Referring now to FIG. 4, there is depicted an end view of an assembly 2*b* according to another embodiment of the present invention. In the assembly 2*b* the at least one extruded aluminum clamping member comprises a first aluminum clamping member 14*a* and a second aluminum clamping member 14*b* which cooperate to provide a pair of opposed clamping portions 16*a*, 16*b*. The assembly 2*b* is shown in use in FIG. 4 with the end 17 of second member 12 clamped therein. Each of the first and second clamping members 14*a*, 14*b* have end portions 19*a*, 19*b* remote from clamping portions 16*a*, 16*b* which act as tongues that are retained in respective slots 3*a*, 3*b* that are defined by L-shaped retaining formations 18*a*, 18*b* that extend from an inner side of wall 8 of the housing 4.

Figure 5:
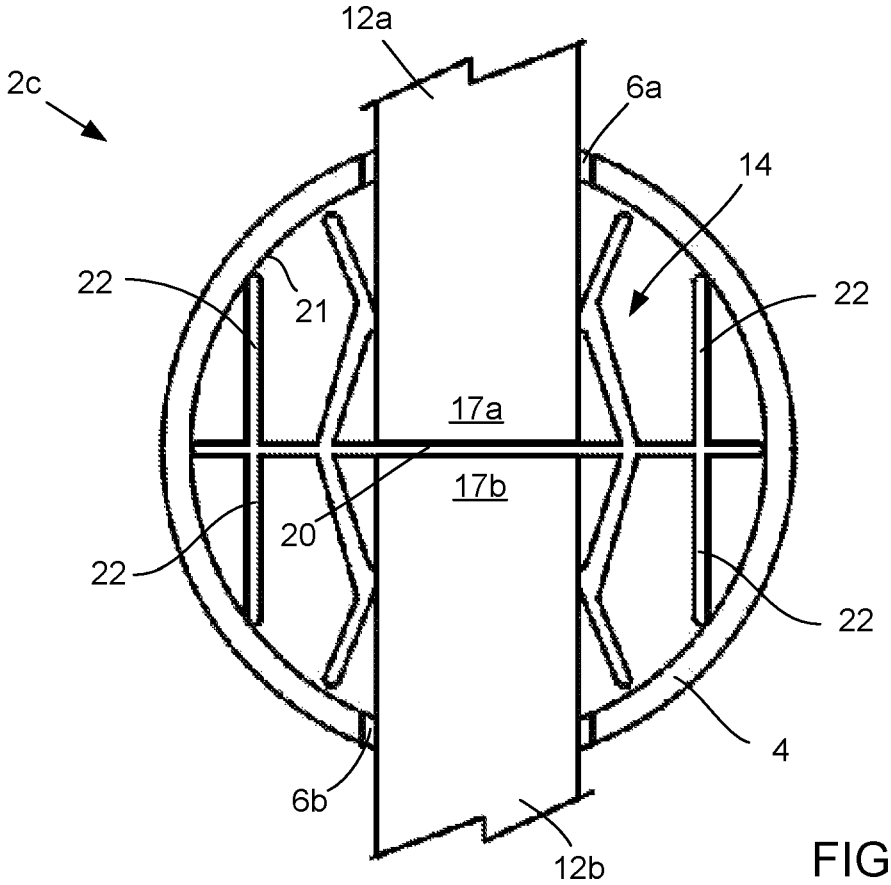

FIG. 5 depicts an end view of an assembly 2*c* according to a further embodiment of the present invention shown in use wherein extruded aluminum clamping member 14 is clamping ends 17*a*, 17*b* of second members 12*a* and 12*b*, which have been inserted through holes 6*a* and 6*b*. In the assembly 2*c* the extruded aluminum clamping member 14 includes bracing members 22 that extend outwardly from transverse member 20 to make contact with one or more inner walls 21 of the housing member 4 to thereby strengthen the housing member 4.

Figure 6:
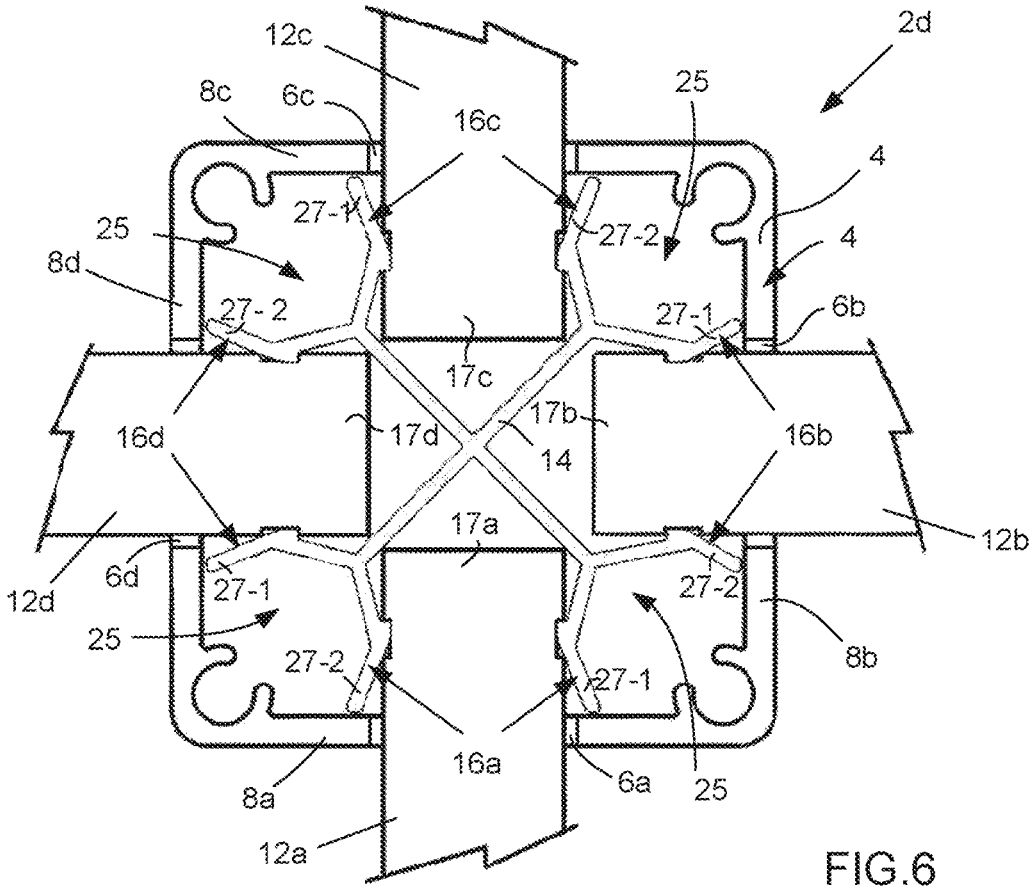

FIG. 6 depicts an assembly 2*d* according to a further embodiment of the present invention. The assembly 2*d* includes a cruciform clamping member 14 wherein ends 25 of the cruciform clamping member 14 are bifurcated and wherein bifurcated portions 27-1, 27-2 of adjacent ends 25 comprise the opposed clamping portions 16*a*, . . . , 16*d*.

In assembly 2*d* the housing member 4 comprises a square cross section extrusion with four series of one or more holes 6*a*, 6*b*, 6*c*, 6*d* formed along respective ones of each of the four sides 8*a*, 8*b*, 8*c*, 8*d*. As shown in FIG. 6, the cruciform clamping member 14 clamps the ends of the second extrusions 12*a*, . . . , 12*d*, which are radially disposed at 90 degrees therebetween. Consequently the assembly 2*d* of FIG. 6 is well suited to use as a vertical post for example where it is desirable to set up four screens each comprised of a plurality of the second extrusions (12*a*, 12*b*, 12*c*, 12*d*) that radiate out from the vertical post as slats of four screens.

Figure 7:
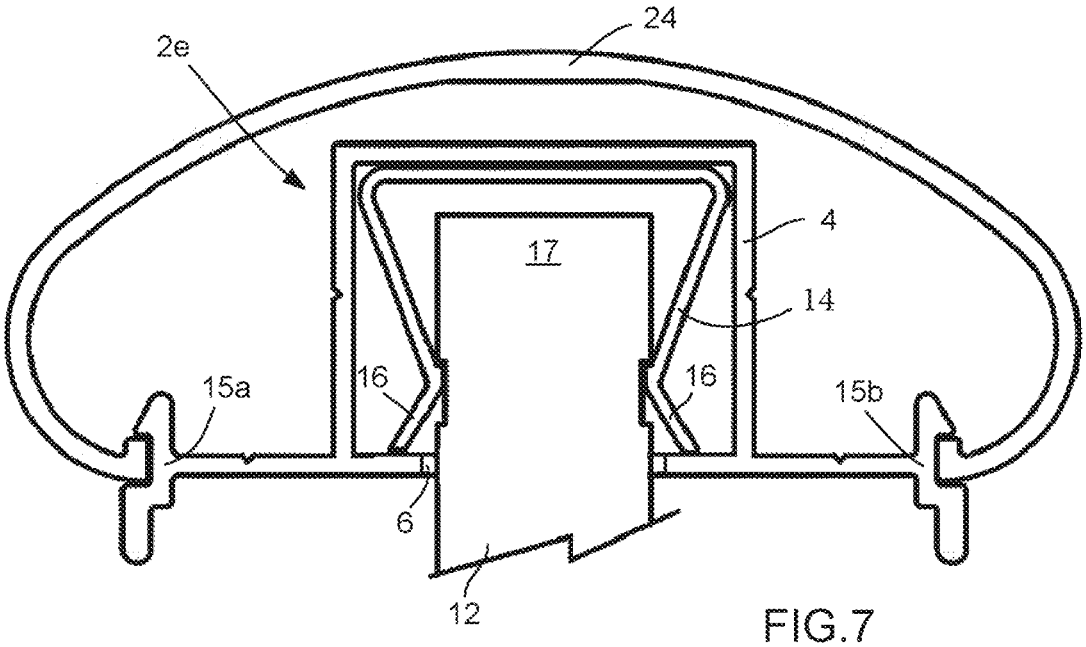

FIG. 7 shows a further assembly 2*e* according to another embodiment of the present invention which includes lateral wings 15*a*, 15*b*, to opposed ends of which a balustrade cover 24 is snap-locked. In this assembly the one or more second members 12 act as a vertical post for supporting the balustrade.

FIGS. 8 to 12 depict end views of further assemblies 2*f*-2*k* of extruded members 2*f*-2*k* according to various embodiments of the invention. In these various embodiments like components to those previously described are item numbered in similar fashion.

Figure 8:
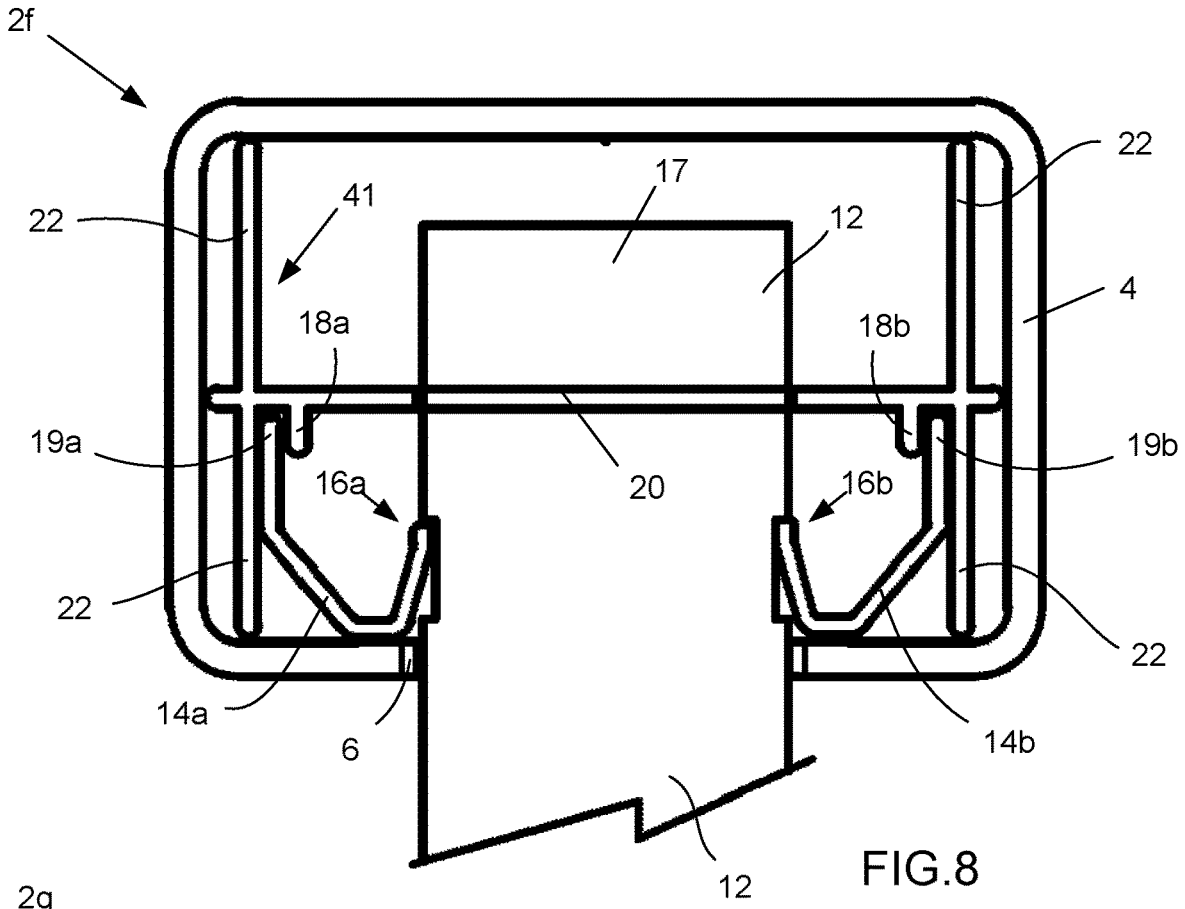

In FIG. 8, the at least one clamping member comprises first and second clamping members 14*a*, 14*b* and the assembly 2*f* includes a clamping member retaining assembly 41 (which is generally "H" shaped in profile in the example of FIG. 8) defining at least first and second longitudinal retainers 18*a*, 18*b* for engaging ends 19*a*, 19*b* of the first and second clamping members 14*a*, 14*b*.

The clamping member retaining assembly 14 is formed with a transverse member in the form of beam which is formed with one or more holes along it for passage of the ends 17 of the one or more second extrusions 12 therethrough.

In the embodiment illustrated in FIG. 8 the at least one clamping member comprises a first clamping member 14*a* and a second clamping member 14*b* wherein the one or more pairs of opposed clamping portions comprises one pair of opposed clamping portions 16*a*, 16*b* formed of a clamping portion 16*a* on the first clamping member 14*a* and a clamping portion 16*b* on the second clamping member 14*b*.

With reference to FIG. 2, in some embodiments that have been described, it will be observed that, the at least one extruded aluminum clamping member 14 includes opposed inwardly converging elongate portions 27, that converge inwardly into the housing member 14 from the one or more openings 6 to the opposed clamping portions 16 which are separated by an unclamped distance d that is is a little less than a width w of the second extrusion for clamping therebetween.

In some embodiments, such as assembly 2 of FIG. 2, the inwardly converging elongate portions 27 are continuous with inwardly diverging elongate portions 29 that diverge inwardly into the first extrusion (to the transverse beam member 20 in the case of assembly 2 of FIG. 2) from the opposed clamping portions 16.

Figure 9:
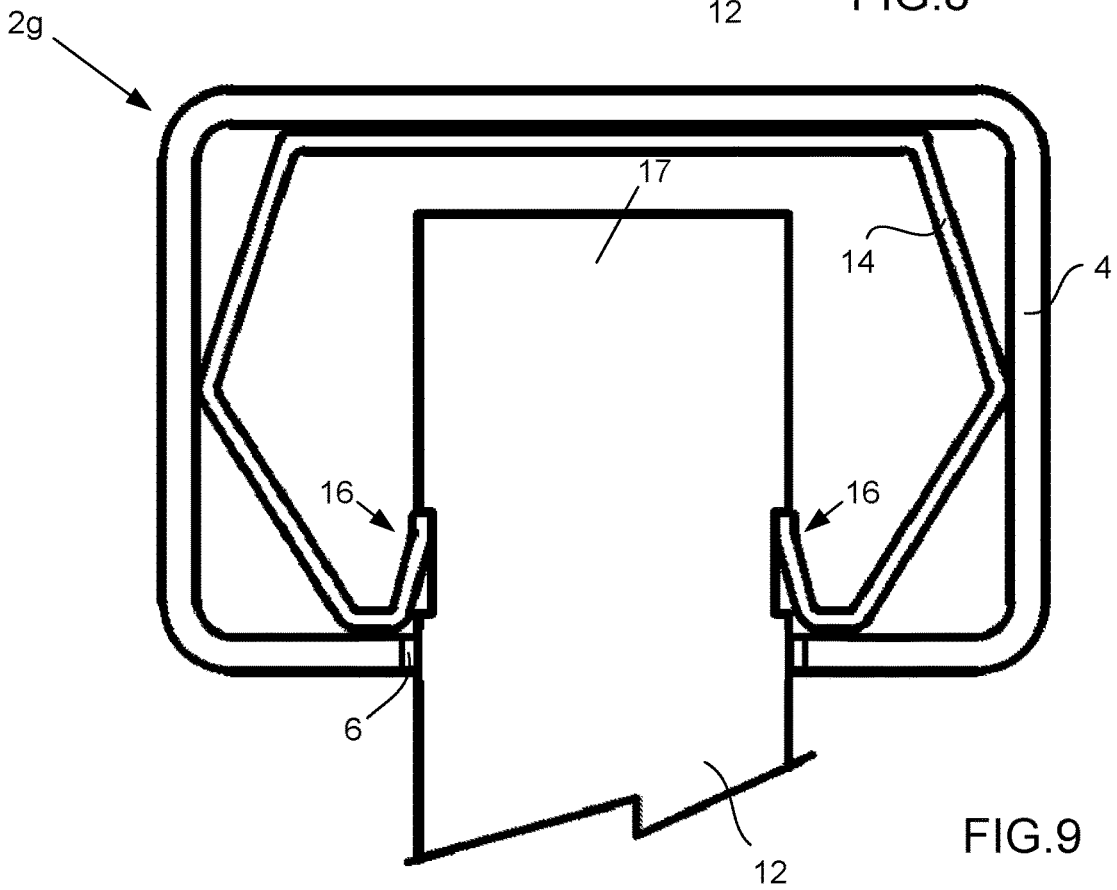
Figure 10:
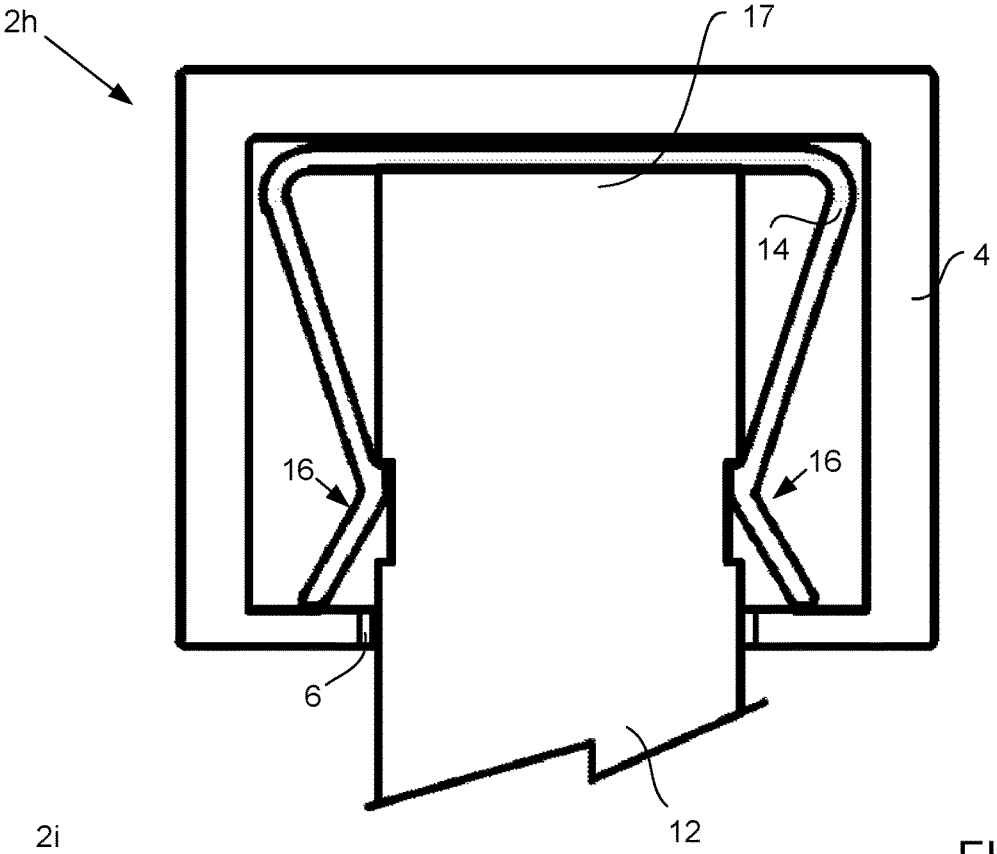
Figure 11:
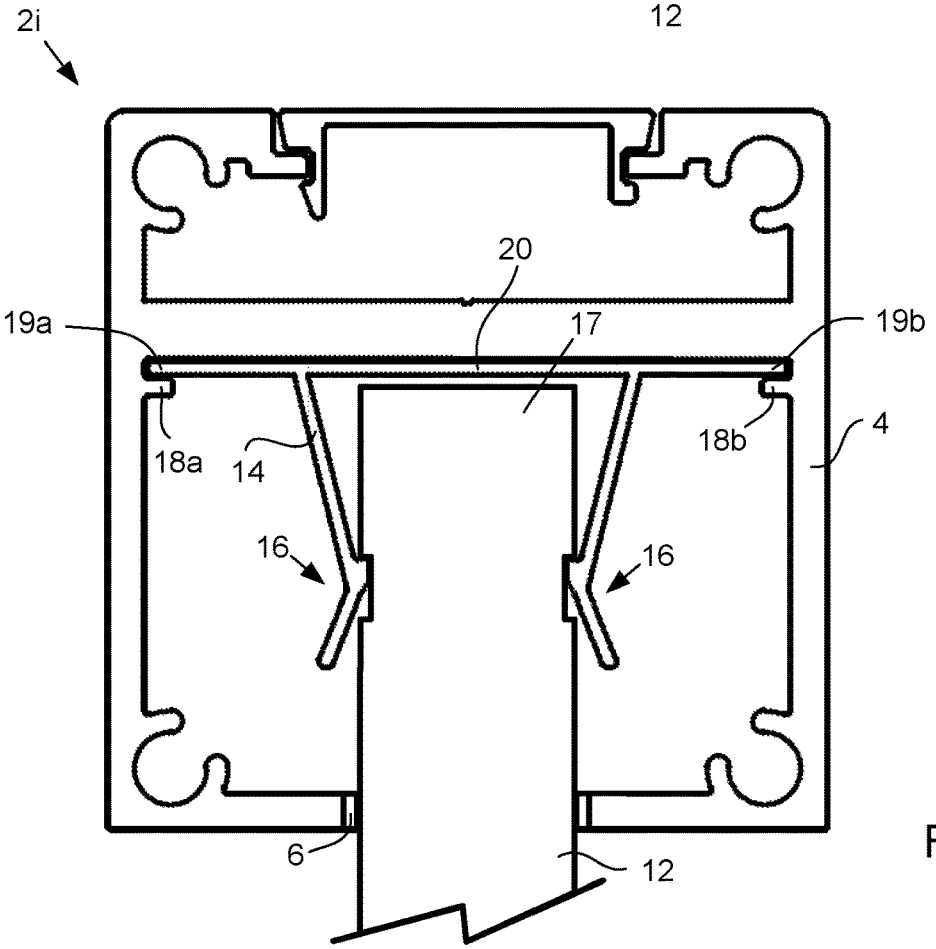
Figure 12:
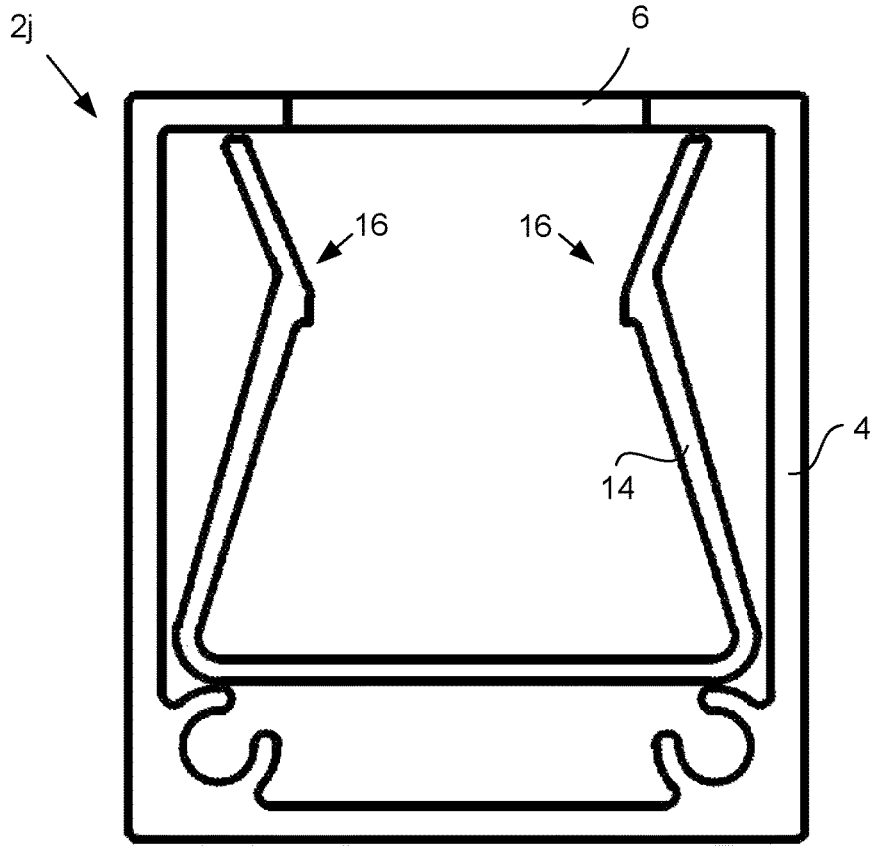
Figure 12A:
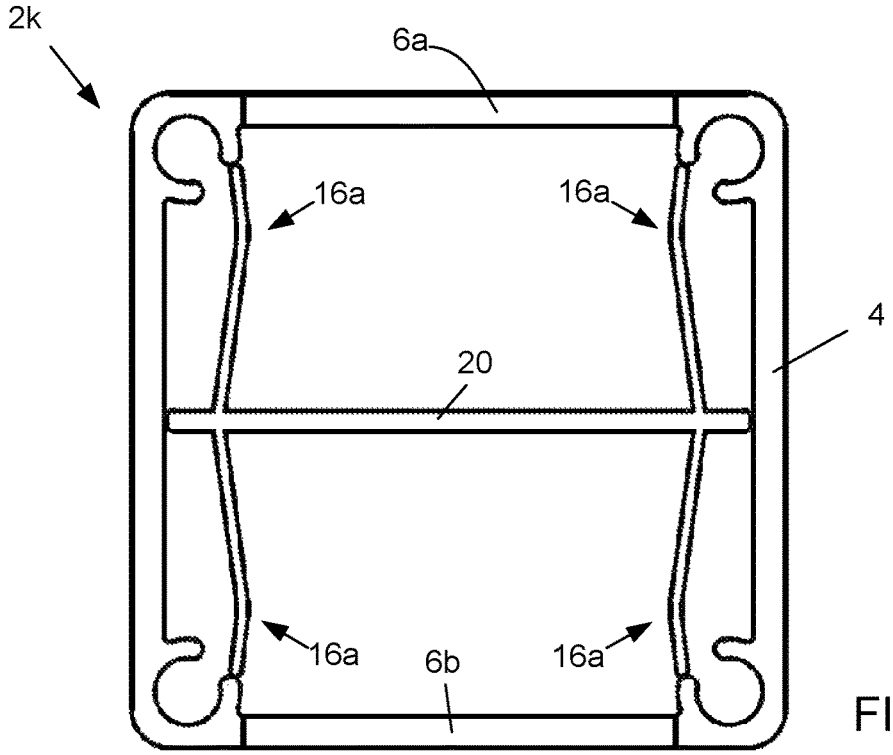

The opposed clamping portions 16 in some embodiments include at least one detent 31, which may be a protrusion that presents a right angle (as shown in FIG. 2) or the end of a clamping portion (as shown in FIGS. 8 and 9 for example). The detent is for or engaging at least one respective stop 33 formed on the second extrusions 12 for preventing withdrawal of the second extrusions from the at least one clamping member once the ends 17 of the members have been pushed through the clamping regions a sufficient distance for detent 31 to engage stop 33 as shown in FIGS. 5, 6, 7, 8, 9, 10 and 11. Stop 33 is preferably a groove with right-angled side as shown that is cut down the side of second extrusion 12, though it could also be a protrusion with a sawtooth profile, example.

Pushing end 17 of member 12 through clamping portions 16 causes the clamping portions to spread apart and exert a clamping force on end 17 due to their spring-like tendency to move back together in order to return to their rest state.

The housing member and the one or more second members may be made of a synthetic material such as vinyl, a composite material or a metal member such as a steel or aluminum extrusion.

It will be realized that an embodiment provides a method for attaching two members, e.g. a housing member 4 and second member 12 (which may be a horizontal member for a screen for example) to each other. In this embodiment the method includes inserting an extruded clamping member (e.g. clamping member 14) into housing member 4. The housing member 4 may have one or more holes along one or more sides, for example holes 6 as illustrated in FIG. 1 along side 8 of housing member 4. Alternatively the housing member 4 may have one long hole along one side as illustrated in FIG. 1*a* so that there is an opening along the length of that side.

Ends 17 of one or more second extrusions 12 are inserted through the one or more holes 6 between opposed clamping portions 16 of the extruded aluminum clamping member 14 which has been inserted into the housing 4. Accordingly the ends of the one or more second members are firmly held within the housing 14.

The method may include inserting at least one portion of the extruded clamping member, for example a tongue 19 along a longitudinal retainer, such as a slot, on an inner wall of the first extrusion. The tongue and slot arrangement is not essential and is not present in all embodiments described herein. However the tongue and slot arrangement is preferable as it assists in firmly locating the clamping member within the housing.

In another embodiment a method is provided for attaching a first extrusion in the form of an extruded housing member 4 to one or more second extrusions 12 that involves forming one or more holes 6 along the first extrusion 4, for example by punching with a mandrill. An extruded aluminum clamping member 14 is then inserted along the first extrusion, e.g. by pushing an end of the clamping member 14 into an end of the extruded housing member 4. The method then involves inserting ends of the one or more second extrusions 12 through corresponding ones of the one or more holes 6 and between opposed clamping formations 6*a,* 6*b* of the extruded aluminum clamping member 14.

The method may include inserting portions 19*a,* 19*b* of the extruded aluminum clamping member 14 into retaining formations 18*a,* 18*b* formed along the first extrusion.

In compliance with the statute, the invention has been described in language more or less specific to structural or methodical features. The term "comprises" and its variations, such as "comprising" and "comprised of" is used throughout in an inclusive sense and not to the exclusion of any additional features. It is to be understood that the invention is not limited to specific features shown or described since the means herein described herein comprises preferred forms of putting the invention into effect. The invention is, therefore, claimed in any of its forms or modifications within the proper scope of the appended claims appropriately interpreted by those skilled in the art.

Throughout the specification and claims (if present), unless the context requires otherwise, the term "substantially" or "about" will be understood to not be limited to the value for the range qualified by the terms.

Any embodiment of the invention is meant to be illustrative only and is not meant to be limiting to the invention. Therefore, it should be appreciated that various other changes and modifications can be made to any embodiment described without departing from the spirit and scope of the invention.

Features, integers, or groups thereof described in conjunction with a particular aspect, embodiment or example of the invention are to be understood to be applicable to any other aspect, embodiment or example described herein unless clearly incompatible therewith.

The invention claimed is:

1. An assembly of extruded members, including:

a first elongate extruded member or housing having one or more side walls wherein at least one of said side walls includes an opening defined by opposing portions of said side wall or said side walls, said opening extending the entire length of said first elongate extruded member;

one or more clamping members maintained in an operative attitude by their engagement with one or more side walls of said first extruded member, said one or more clamping members defining a mouth that is aligned with said opening and two opposing, spaced apart, clamping portions that are each connected to said mouth by a respective inclined guide face and wherein said guide faces diverge inwardly towards one another in the direction of said clamping portions, and a second elongate extruded member having an end portion, and whereby when assembling the extruded members, said end portion shall be extended through said opening and said mouth, and wherein engagement of said end portion with said guide faces shall urge said clamping portions further apart until at least said clamping portions engage said end portion.

2. An assembly of extruded members as claimed in claim 1, wherein said first extruded member includes at least one longitudinally extending retainer that is capable of engaging with a portion of said clamping member.

3. An assembly of extruded members as claimed in claim 1, wherein a beam extends between opposing portions of said first extruded member and wherein said one or more extruded clamping members are engaged with said beam and at least said one or more side walls of said first extruded member.

4. An assembly of extruded members as claimed in claim 1, wherein a beam extends between opposing portions of said first extruded member and said opening is a first opening, said first extruded member being provided with a second opening formed in said side wall or said side walls that extends the entire length of said first extruded member, and wherein said assembly includes one or more additional aluminium extruded clamping members that are maintained in an operative attitude by their engagement with one or more side walls of said first extruded member and said beam, said additional one or more clamping members defining a mouth that is aligned with said second opening and two opposing, spaced apart, clamping portions that are each connected to said mouth by a respective inclined guide face and wherein said guide faces diverge inwardly towards one another in the direction of said clamping portions.

5. An assembly of extruded members as claimed in claim 4, wherein said first extruded member has a substantially square shaped transverse cross-section and includes four side walls, and wherein said first opening and said second opening are located in opposing side walls.

6. An assembly of extruded members as claimed in claim 1, wherein said opposed clamping portions include a detent for engaging a respective stop formed on said second extrusion for preventing withdrawal of said second extrusion from said first extruded member.

7. An assembly of extruded members, including:

a first elongate extruded member or housing having one or more external side walls and a plurality of internal walls that divide the interior of said first extruded member being defined by said one or more external side walls and at least one of said internal walls;

a plurality of openings in said external side wall or said side walls;

one or more aluminium extruded clamping members accessible by one of said openings, said one or more clamping members being maintained in an operative attitude by their engagement with one or more side walls of said first extruded member and at least one of said internal side walls, said one or more clamping members defining a mouth that is aligned with said opening and two opposing, spaced apart, clamping portions that are each connected to said mouth by a respective inclined guide face and wherein said guide faces diverge inwardly towards one another in the direction of said clamping portions, and a second elongate extruded member having an end portion, and whereby when assembling the extruded members, said end portion shall be extended through said opening and said mouth, and wherein engagement of said end portion with said guide faces shall urge said clamping portions further apart until at least said clamping portions engage said end portion.

8. An assembly of extruded members as claimed in claim 7, wherein said internal walls resemble a cruciform.

9. An assembly of extruded members as claimed in claim 8, wherein said openings extend the entire length of said first extruded member.

10. An assembly of extruded members as claimed in claim 9, wherein one of said openings includes at least one longitudinally extending retainer that is capable of engaging with a portion of said clamping member.

11. An assembly of extruded members as claimed in claim 10, wherein said first extruded member has a substantially square shaped transverse cross-section and includes four side walls, each of said side walls including at least one opening through which an end of a respective second extrusion can extend therethrough.

12. An assembly of extruded members as claimed in claim 7, wherein said opposed clamping portions include a detent for engaging a respective stop formed on said second extrusion for preventing withdrawal of said second extrusion from said first extruded member.

* * * * *